United States Patent [19]

Araki et al.

[11] Patent Number: 4,721,188

[45] Date of Patent: Jan. 26, 1988

[54] CONTROL APPARATUS FOR A.C. ELEVATOR

[75] Inventors: Hiroshi Araki; Tooru Tanahashi, both of Inazawa, Japan

[73] Assignee: Mitsubishi Denki Kabushiki Kaisha, Japan

[21] Appl. No.: 32,541

[22] Filed: Apr. 1, 1987

[30] Foreign Application Priority Data

Apr. 3, 1986 [JP] Japan ..... 61-77068

[51] Int. Cl.[4] ..... B66B 1/06

[52] U.S. Cl. ..... 187/119; 363/37

[58] Field of Search ..... 187/119; 318/811; 363/37

[56] References Cited

U.S. PATENT DOCUMENTS 4,454,930 6/1984 Nomura et al. ..... 187/119
4,471,855 9/1984 Nomura ..... 187/119
4,482,031 11/1984 Yoshida et al. ..... 187/119
4,503,938 3/1985 Nomura ..... 187/119
4,625,159 11/1986 Ikejima ..... 318/811
4,667,777 5/1987 Nomura ..... 318/811

FOREIGN PATENT DOCUMENTS 58-22271 2/1983 Japan .

*Primary Examiner*—William M. Shoop, Jr.
*Assistant Examiner*—W. E. Duncanson, Jr.
*Attorney, Agent, or Firm*—Leydig, Voit & Mayer

[57] ABSTRACT

A control apparatus for an A.C. elevator comprises resistances connected between an A.C. power source and a converter, a detection device to detect the build-up rate of the charged voltage of a smoothing capacitor, and control means to generate a signal for closing a contact interposed between the A.C. power source and the converter, when the output of the detection device is not greater than a predetermined value. The detection and control devices are preferably provided by a microcomputer.

6 Claims, 5 Drawing Figures

CONTROL APPARATUS FOR A.C. ELEVATOR

BACKGROUND OF THE INVENTION

This invention relates to an apparatus for controlling an elevator which is driven by an induction motor.

FIG. 5 is an arrangement diagram which shows a prior-art control apparatus for an A.C. elevator disclosed in the official gazette of Japanese Patent Application Laid-open No. 22271/1983 by way of example.

Referring to the figure, numeral 1 designates a converter which is connected to the phases R, S and T of a three.-phase A.C. power source and in which a three-phase full-wave rectifier circuit is constructed of thyristors 1*a*–1*f*. Connected across the D.C. side of the converter 1 is a smoothing capacitor 2 which smooths the D.C. output of the converter 1. Numeral 3 designates an inverter which is connected across both the terminals of the smoothing capacitor 2 and which is constructed of, e.g., thyristors. This inverter 3 inverts direct current into alternating current, the voltage and frequency of which are made variable. A three-phase induction motor 4 is connected to the A.C. side of the inverter 3, a brake wheel 5 is coupled to the motor 4, a brake shoe 6 is disposed in opposition to the outer periphery of the brake wheel 5 and applies a braking force to the brake wheel 5 owing to the force of a spring (not shown), and a brake coil 7 operates when energized, to separate the brake shoe 6 from the brake wheel 5 against the force of the spring. A driving sheave 8 for a hoist is driven by the motor 4, a main rope 9 is wound round the sheave 8, and a cage 10 and a counterweight 11 are coupled to the main rope 9. The contacts 12*a*–12*c* of an operating electromagnetic contactor, which are respectively inserted between the power source phases R, S and T and the converter 1, are closed when running the cage 10 and are opened when stopping it. The contacts 13*a*–13*c* of an operating electromagnetic contactor, which are inserted between the inverter 3 and the motor 4, are closed after the closure of the contacts 12*a*–12*c* and are opened after the opening of them. Numeral 14 indicates a rectifier circuit which is connected between the power source R, S, T and the smoothing capacitor 2 and in which a three-phase full-wave rectifier circuit is constructed of diodes 14*a*–14*f*. A resistor 15 is inserted on the D.C. side of the rectifier circuit 14.

With the prior-art control apparatus for the A.C. elevator constructed as described above, while the cage 10 is at a stop, the brake shoe 6 depresses the brake wheel 5 owing to the force of the spring. In addition, the smoothing capacitor 2 is normally charged through the rectifier circuit 14 as well as the resistor 15.

When a start command has been given to the cage 10, the contacts 12*a*–12*c* of the electromagnetic contactor are closed, and the converter 1 produces a D.C. output. Since, however, the smoothing capacitor 2 is charged beforehand, the rapid charging of the smoothing capacitor 2 by a low-impedance direct current attributed to the converter 1 can be avoided. Thus, the D.C. output of the converter 1 is supplied to the inverter 3, and the control elements (not shown) of the respective arms of the inverter 3 are successively turned 'on' according to a running direction and generate A.C. outputs of variable voltage and variable frequency in a phase sequence corresponding to the running direction. The contacts 13*a*–13*c* of the electromagnetic contactor are closed, and the above outputs are supplied to the motor 4. At the same time, the brake coil 7 is energized, so that the brake shoe 6 comes away from the brake wheel 5. Thus, the motor 4 starts in a direction determined by the phase sequence of the inputs, and the cage 10 begins to run.

In the prior-art control apparatus for the A.C. elevator as described above, the smoothing capacitor 2 is normally charged through the rectifier circuit 14 in order to prevent the rapid charging. This leads to the problem that the circuit arrangement becomes complicated.

SUMMARY OF THE INVENTION

This invention has the objective to solve the problem mentioned above, and has for its main object to provide a control apparatus for an A.C. elevator which can simplify the circuit arrangement thereof and which can render a charging detection time the shortest against fluctuations in the voltage of a power source and fluctuations in the capacitance of a smoothing capacitor.

The control apparatus for an A.C. elevator according to this invention comprises resistance means connected between an A.C. power source and a converter, detection means to detect the build-up rate of the charged voltage of a smoothing capacitor, and control means to generate a signal for closing a contact interposed between the A.C. power source and the converter, when the output of the detection means is not greater than a predetermined value.

In this invention, the smoothing capacitor is charged through the resistors beforehand, and the A.C. power source is operatively connected to the converter when the build-up rate of the charged voltage of the smoothing capacitor is not greater than the predetermined value, so that an inrush charging current does not flow to the smoothing capacitor. Moreover, as regards fluctuations in the voltage of the power source and fluctuations in the capacitance of the smoothing capacitor, a charging detection time need not allow for the fluctuating components.

BRIEF DESCRIPTION OF THE DRAWINGS

Throughout the drawings, the same symbols indicate identical portions.

DESCRIPTION OF THE PREFERRED EMBODIMENT

Figure 1:
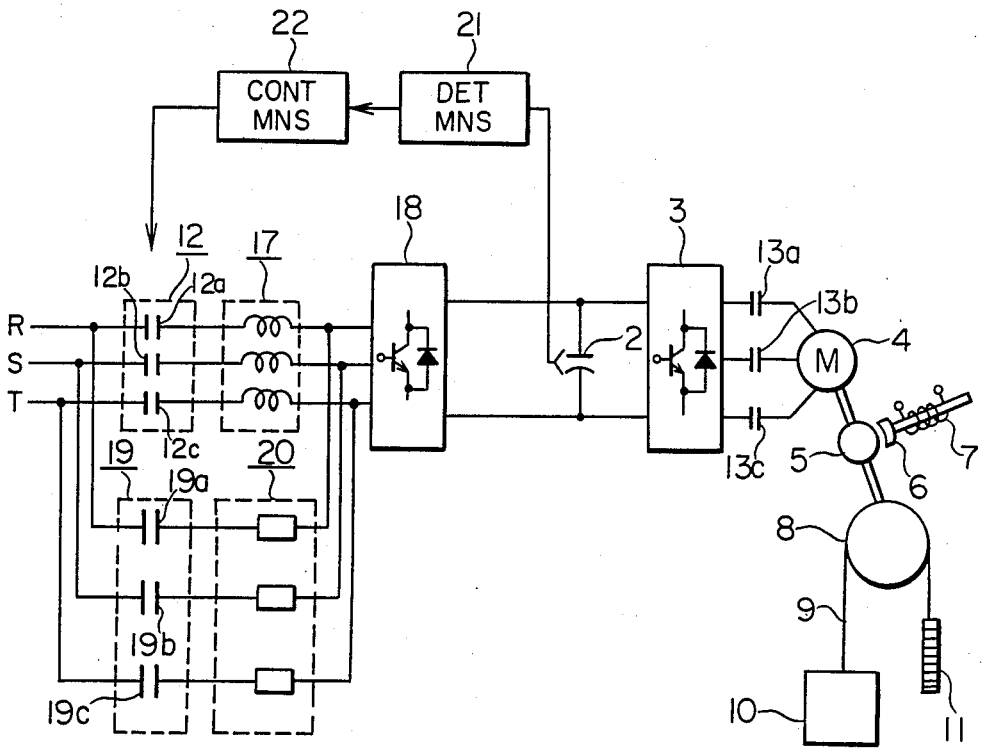
FIG. 1 is a general arrangement diagram of a control apparatus for an A.C. elevator embodying this invention.
Figure 2:
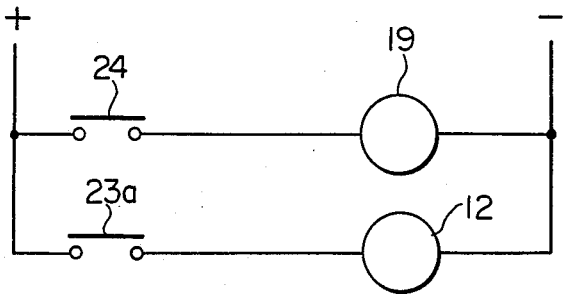
FIG. 2 is a circuit diagram of electromagnetic contactors.
Figure 3:
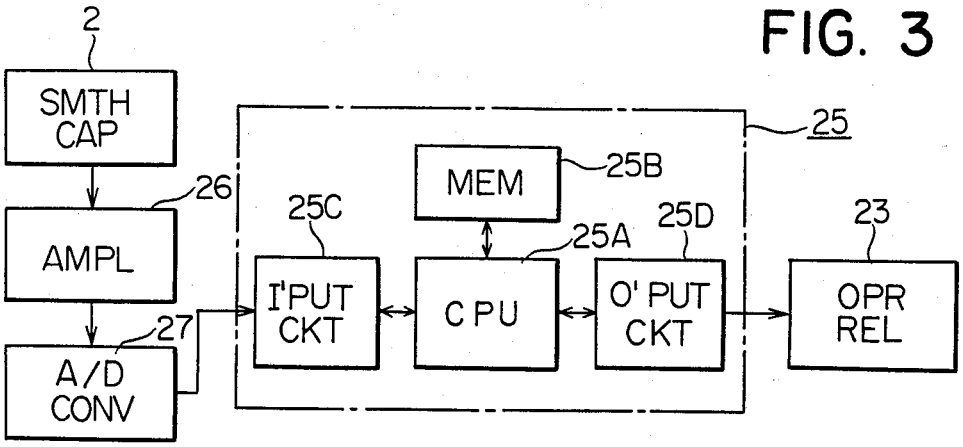
FIG. 3 is a block diagram of detection means and control means.
Figure 4:
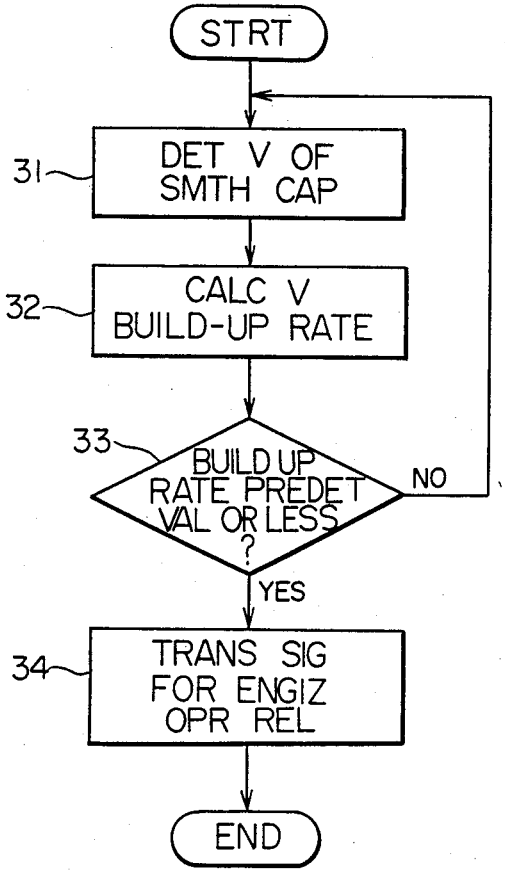
FIG. 4 is a flow chart showing the operation of the means in FIG. 3.

FIGS. 1–4 are diagrams showing one embodiment of this invention, in which FIG. 1 is a general arrangement diagram, FIG. 2 is a circuit diagram of electromagnetic contactors, FIG. 3 is a block diagram of detection means and control means, and FIG. 4 is a flow chart showing operations in FIG. 3. In the drawings, letters R, S and T, numerals 2–11, symbols 12*a*–12*c* and symbols 13*a*–13*c* indicate the same portions as in the prior-art apparatus described above.

In FIGS. 1 and 2, numeral 12 designates an operating electromagnetic contactor which actuates the contacts 12a–12c. A.C. reactors 17 are respectively connected to the contacts 12a–12c. A converter 18 for converting alternating current into direct current is connected to the A.C. reactors 17, and is constructed of transistors, diodes etc. Numeral 19 denotes a charging electromagnetic contactor, which has normally-open contacts 19a–19c. Impedance elements 20 made up of resistors are respectively connected between the contacts 19a–19c and the A.C. side of the converter 18. Detection means 21 receives the terminal voltage of the smoothing capacitor 2 and detects the build-up rate of the charged voltage of the smoothing capacitor 2, while control means 22 generates a signal when the output of the detection means 21 is not greater than a predetermined value. Symbol 23a denotes the normally-open contact of an operation relay 23 (FIG. 3) which is energized by the signal of the control means 22. Numeral 24 indicates the contact of a start command relay, which is closed when a start command is issued.

Referring to FIG. 3, numeral 25 indicates a microcomputer (hereinbelow, abbreviated to "MC") which constructs the detection means 21 and the control means 22 in FIG. 1. The MC 25 includes a CPU 25A, a memory 25B, an input circuit 25C and an output circuit 25D. The smoothing capacitor 2 is connected to the input circuit 25C through an isolation amplifier 26 as well as an analog/digital (A/D) converter 27, and the operation relay 23 is connected to the output circuit 25D.

Next, the operation of the embodiment will be described by referring also to FIG. 4. This figure is a flow chart showing a program which is stored in the memory 25B of the MC 25.

When the start command is given, the start command relay contact 24 is closed, and the charging electromagnetic contactor 19 is energized to close the contacts 19a–19c. Thus, the converter 18 is operatively connected to the A.C. power source R, S, T through the impedance elements 20, so that the smoothing capacitor 2 is charged. Meanwhile, the voltage of the smoothing capacitor 2 is fed into the input circuit 25C through the A/D converter 27.

Figure 5:
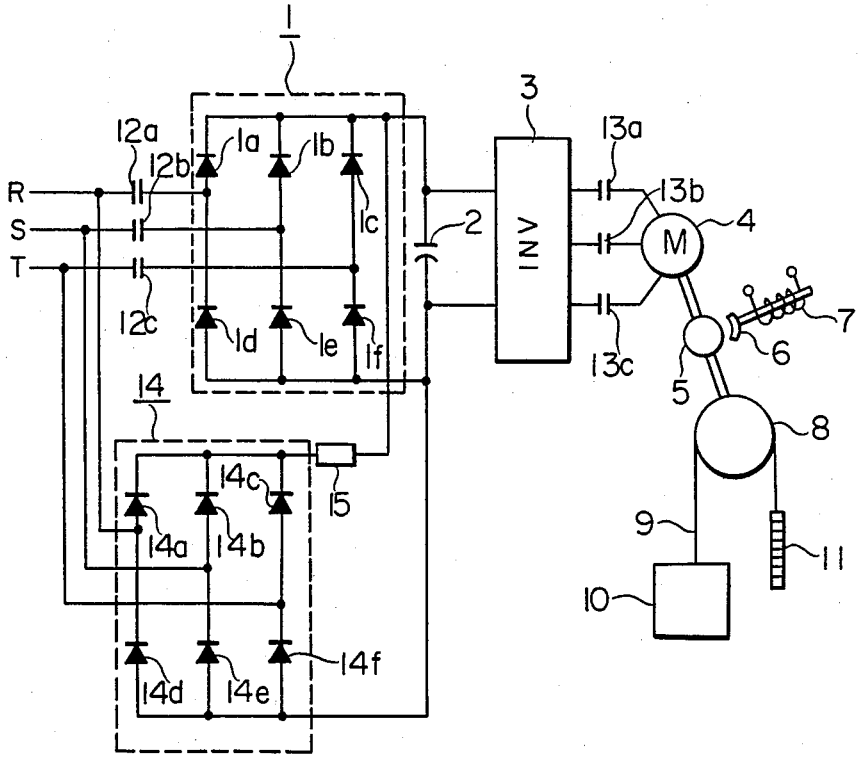
FIG. 5 PRIOR ART
FIG. 5 is an arrangement diagram showing a control apparatus for an A.C. elevator in a prior art.

Here, a detection operation formed of steps 31–33 and a control operation formed of a step 34 in FIG. 4 are executed. The voltage of the smoothing capacitor 2 is detected at the step 31, and the build-up rate of the charged voltage of the capacitor 2 is calculated at the step 32. The step 33 decides if the build-up rate is equal to or less than the predetermined value. When the predetermined value is exceeded, the operating flow returns to the step 31, and the steps 31–33 are repeatedly executed. When the predetermined value is not exceeded, the operating flow proceeds to the step 34, at which the operation relay 23 is energized. Thus, the contact 23a is closed, so that the operating electromagnetic contactor 12 is energized to close the contacts 12a–12c. The subsequent operations are similar to those explained in conjunction with FIG. 5.

In this way, when the voltage build-up rate of the smoothing capacitor 2 is in excess of the predetermined value, that is, when the charging of the capacitor 2 is unsettled, the contacts 12a–12c are not closed, and hence, inrush charging currents do not flow to the diodes of the converter 18 and the smoothing capacitor 2. Besides, as regards fluctuations in the supply voltage and fluctuations in the capacitance of the smoothing capacitor 2, the period of time for detecting the charging need not allow for the fluctuating components, so that the optimum charging detection time is attained, and the charging detection time becomes the shortest.

As described above, according to this invention, resistors are connected between an A.C. power source and a converter, and the build-up rate of the charged voltage of a smoothing capacitor is detected so as to operatively connect the A.C. power source and the converter when the build-up rate does not exceed a predetermined value. Therefore, the invention produces the effects that, with a simple circuit arrangement, a great charging current can be prevented from flowing to the smoothing capacitor at the start of a cage, and that a charging detection time can be rendered the shortest against fluctuations in the voltage of the power source and fluctuations in the capacitance of the smoothing capacitor.

What is claimed is:

1. A control apparatus for an A.C. elevator, comprising:

a converter which is connected to an A.C. power source through a first contact, and by which A.C. power fed from the A.C. power source is converted into direct current, a smoothing capacitor which smooths the D.C. output of said converter, an inverter by which a smoothed output from said smoothing capacitor is inverted into A.C. power of variable frequency, an induction motor which is driven by the A.C. output of said inverter and which operates a cage of the elevator, impedance elements which are connected between the A.C. power source and said converter, detection means to detect a build-up rate of a charged voltage of said smoothing capacitor, and control means to generate a signal for closing said first contact when the output of said detection means does not exceed a predetermined value.

2. A control apparatus for an A.C. elevator as defined in claim 1, wherein said each impedance element is a resistor.

3. A control apparatus for an A.C. elevator as defined in claim 1, wherein A.C. reactors are connected between said first contact and said converter.

4. A control apparatus for an A.C. elevator as defined in claim 1, wherein a second contact is connected between the A.C. power source and said impedance elements, and it is closed by a start command for the cage.

5. A control apparatus for an A.C. elevator as defined in claim 1, wherein said detection means and said control means are constructed by a microcomputer.

6. A control apparatus for an A.C. elevator as defined in claim 5, wherein said microcomputer is fed with a signal obtained by amplifying the charged voltage of said smoothing capacitor and then subjecting the amplified voltage to analog-to-digital conversion, and it delivers the signal for controlling opening and closure of said first contact.

* * * * *